US005557916A

United States Patent [19]

Messmer et al.

[11] Patent Number: 5,557,916

[45] Date of Patent: Sep. 24, 1996

[54] DEVICE FOR ADJUSTMENT OF THE PARAMETERS FOR OPTIMAL PIECING OPERATIONS ON A ROTOR SPINNING MACHINE

[75] Inventors: Susanne Messmer; Josef Müller, both of Ingolstadt, Germany

[73] Assignee: Rieter Ingolstadt Spinnereimaschinenbau AG, Ingolstadt, Germany

[21] Appl. No.: 450,526

[22] Filed: May 25, 1995

[30] Foreign Application Priority Data

Sep. 7, 1994 [DE] Germany ..... 44 31 810.3

[51] Int. Cl.[6] ..... D01H 11/00; D01H 13/04

[52] U.S. Cl. ..... 57/261; 57/263; 57/264

[58] Field of Search ..... 57/263, 264, 265, 57/261

[56] References Cited

U.S. PATENT DOCUMENTS

| | | | |
|---|---|---|---|
| 4,047,371 | 9/1977 | Stahlecker | 57/34 R |
| 4,178,749 | 12/1979 | Stahlecker et al. | 57/263 |
| 4,192,129 | 3/1980 | Stahlecker | 57/263 |
| 4,408,447 | 10/1983 | Sloupensky et al. | 57/263 |
| 4,660,365 | 4/1987 | Raasch | 57/263 |
| 4,821,502 | 4/1989 | Bur sek et al. | 57/263 |
| 5,386,684 | 2/1995 | Simon et al. | 57/264 |

FOREIGN PATENT DOCUMENTS

| | | | |
|---|---|---|---|
| 4030100 | 4/1992 | Germany | 57/263 |

OTHER PUBLICATIONS

Bedeutung Der Ansetzerqualitat Beim Rotorspinnen Fur Die Weiterverarbeitung Vorstellung Eines Neuen Ansetzprozesses, May, 1993.

*Primary Examiner*—William Stryjewski
*Attorney, Agent, or Firm*—Dority & Manning

[57] ABSTRACT

The process and device for setting optimal piecing parameters in the spinning machine when changing batches includes entering and storing in a memory of a central machine computer spinning machine data relevant to the piecing operation. At the start of the piecing operation, the machine data is transmitted from the central machine computer to a microcomputer of a piecing device. The microcomputer contains a piecing program and a database of piecing parameters pertaining to the piecing process. An optimal set of piecing parameters is computed with the piecing program in the microcomputer. The microcomputer incorporates the spinning machine data and computes from the database an optimal basic set of piecing parameters. The optimal set of piecing parameters is displayed at an optical display unit associated with the microcomputer and can be manually adjusted.

4 Claims, 1 Drawing Sheet

DEVICE FOR ADJUSTMENT OF THE PARAMETERS FOR OPTIMAL PIECING OPERATIONS ON A ROTOR SPINNING MACHINE

BACKGROUND OF THE INVENTION

The instant invention relates to the adjustment of the parameters for optimal piecing operations of a piecing device when changing batches on a rotor spinning machine. When batches are changed it is necessary to reset the machine data of the rotor spinning machine for a piecing joint on an empty bobbin and for a piecing joint after yarn breakage.

Forming a piecing joint on an empty bobbin when piecing is necessary when starting the rotor spinning machine or after a replacement of a bobbin on a spinning box. The formation of a piecing joint is however also necessary after breakage at a spinning station in order to continue yarn production on a yarn bobbin.

The SYNCRO TOP piecing technique to be used for this on the rotor spinning machine is described in detail in point 3.7 of the report of Kriechbaum, K., Messmer, S.

Importance of piecing joint quality in rotor spinning for further processing—Presentation of a new piecing process Pages 1–23

Report on the occasion of the 9th spinning mill colloquium on May 4/4 in Enningen.

When batches are changed on the rotor spinning machine it becomes necessary, due to a different type of material and/or yarn number to change the delivery speed and the feeding speed among other things and to replace the rotors used until then with rotors with different diameters. This means different machine data. At the same time the technological parameter of the piecing joint and the parameters for bobbin change had to be entered manually into the piecing device in case of batch change. Both are called piecing joint parameters below. This was expensive and awkward. As a function of these piecing joint parameters and machine data, the piecing joint was produced. The piecing joint parameters influence the aspect of the piecing joint as shown in the above cited article, page 14, FIG. 15. At the same time a distinction had to be made between piecing joints on an empty bobbin and piecing joints after yarn breakage, so that a number of different piecing joint parameters had to be entered by the operator in the state of the art.

The need to enter a number of machine data and piecing joint parameters when changing batches required specialized technological training and a high degree of concentration on the part of the operator in order avoid operator errors. In actual operation however, many operator errors occurred due to multiple input of data or due to the utilization of less qualified operating personnel. It was also a disadvantage for the operating personnel that, together with the parameter input, its effect on the piecing process had to be known. Also, the relatively high number of parameters to be entered at the piecing device in case of batch change proved to be a disadvantage.

OBJECTS AND SUMMARY OF THE INVENTION

It is a principal object of the instant invention to achieve simplification of the adjustment of parameters for optimal piecing joints of a piecing device, so that operator errors are reduced, in particular also when less qualified operating personnel is used. Additional objects and advantages of the invention will be set forth in part in the following description, or may be obvious from the description, or may be learned through practice of the invention.

The objects are attained in that only a reduced number of parameters are to be entered by the operator from the operator level of the piecing device in case of batch change.

The piecing program determines a basic setting for an optimal piecing operation on the basis of corrected piecing parameters and machine data transmitted by the central machine controls. This is done by using a data base. The piecing parameters set with the basic setting are displayed before the piecing process is started and can be corrected manually within set limits by the operator at the operator level. The operator does not have to determine the optimal machine settings himself, as this is done by means of the microcomputer of the piecing device.

The advantage of reducing the number of piecing parameters is achieved in that the microcomputer of the piecing device has a data base, i.e. programmed function tables pertaining to the piecing process and to the piecing joint. These function tables programmed into a data base are changed by incorporating individual parameters into different parameters of greater weight on the basis of functional dependence. Thus, it becomes possible to reduce the formerly relatively high number of piecing parameters which can be displayed and corrected. The number of piecing parameters reduced according to the invention includes the piecing joint thickness, the yarn end overlap in the piecing joint, the yarn end preparation, the rotational speed for piecing and the yarn tension. The basic setting of these piecing parameters is displayed in an optical scale on a display at the operator level of the microcomputer, and by manual input at the operator level, the basic setting can be corrected by the operator parameter by parameter within the limits set for the optical scale.

The invention and its characteristics are described below through a preferred embodiment of the invention.

DETAILED DESCRIPTION OF THE PREFERRED EMBODIMENTS

Figure 1:
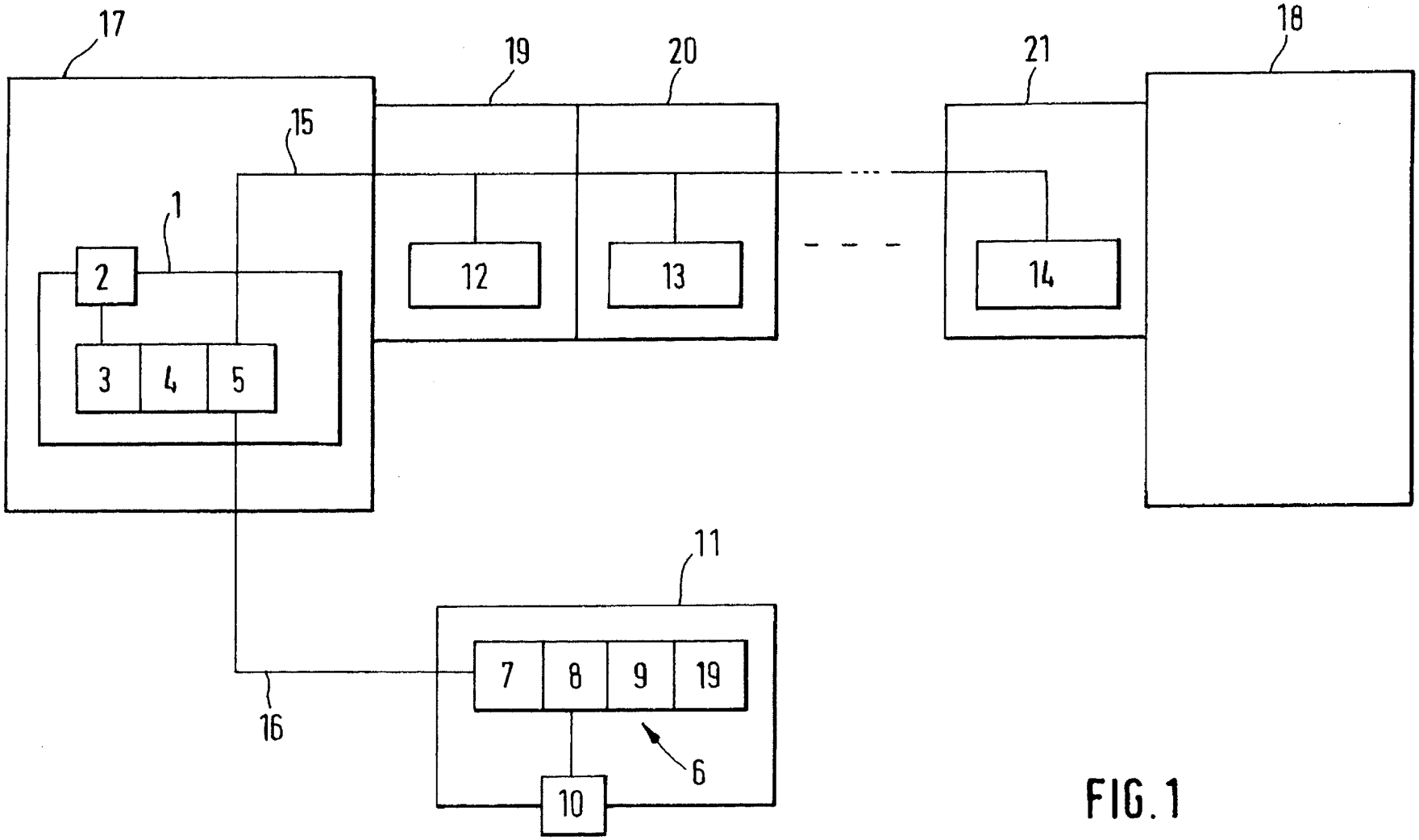
FIG. 1 shows a simplified, functional structure of the interaction between the piecing device and the central machine controls of a rotor spinning machine.

Reference will now be made in detail to the presently preferred embodiments of the invention, one or more examples of which are illustrated in the drawing. Each drawing is provided by way of explanation of the invention, and not meant as a limitation of the invention. For example, various modifications and variations can be made in the present invention without departing from the scope and spirit of the invention.

FIG. 1 shows the outer contours of a rotor spinning machine, with the end section 17, the section frame 19, 20, 21 and the drive section 18. Normally, more section frames than shown are present. The central machine controls 1 are installed in the end section 17, for example. The section frames 19, 20, 21 of which parts are shown support a plurality of operating elements (not shown) for the different spinning stations. To understand the invention it is essential to know that a section electronic system 12, 13, 14 which organizes the control of all operating elements within one section frame is installed in all the individual section frames 19, 20, 21. As a rule the drive of the operating elements is installed in the section frame 18.

The rotor spinning machine is furthermore provided with a rail system (not shown) for a piecing device 11. The piecing device 11 is thus able to patrol around the rotor spinning machine and is able to take up a position in front of each spinning station in order to carry out control tasks and activities in connection with a piecing operation.

The central machine controls 1 contain at least one processor CPU 3, a data memory 4 for machine data, an interface 5 and an operator level 2. The central machine controls 1 are connected via interface 5 in a data circuit 15 to each one of the section electronic systems 12, 13, 14. The section electronic system is essentially a computer which carries out the tasks of data acquisition, control, and communication within a section frame. Communications of an individual spinning station is transmitted to the section electronic system and the section electronic system then communicates with the central machine controls.

The central machine controls 1 are furthermore connected via a control circuit 16 to a microcomputer 6 of a piecing device 11. The microcomputer 6 has a least one CPU 8 processor, one operations memory 9 with a piecing program, a data base 19, an interface 7 and an operator level 10.

When batches are changed, the machine data is entered via the operator level 2 of to the central machine controls 1 and are stored in the data memory 4 for machine data. With the start of the piecing program of the microcomputer 6 of the piecing device 11, the modified machine data is transmitted from the data memory 4 of the central machine controls 1 via control circuit 16 into the piecing program of the microcomputer 6. There, the appropriate machine data is corrected. Based on the machine data concerning delivery speed, feeding speed, and rotor diameter, as well as yarn number which the piecing device 11 receives from the central machine controls 1 via the control circuit 16 and based on the input of the type of material at the operator level 10 of the piecing device, the microcomputer 6 determines a basic setting with its piecing program in the operations memory 9 for the piecing device 11.

The microcomputer 6 of the piecing device 11 is provided with a data base 19 which represents the function tables for the piecing process and the piecing joint entered into the program. These entered function tables for the piecing process and the piecing joint in the data base 19 were changed in such a manner that, based on functional dependence, individual parameters which had been displayed until then are incorporated into other parameters of greater weight, so that the number of piecing parameters to be displayed are reduced. Piecing parameters which were incorporated into other parameters, for instance on the basis of functional dependence, are e.g. the piecing parameter time of sojourn in the rotor, the piecing parameter bobbin run-up, or the piecing parameter piecing-feed before yarn withdrawal. It was possible to reduce the relatively large number of piecing parameters shown on the display of operator level 10. The result was a reduction of the piecing parameters which can be displayed and corrected such as piecing joint thickness, yarn end overlap in the piecing joint, yarn end preparation, piecing rotor speed and yarn tension. Furthermore, the display indicates the type of material and the number of piecing attempts. Another characteristic is the fact that on the display of the operator level 10 of the microcomputer 6 a basic setting of the piecing parameters is shown in an optical scale and in that this basic setting can be corrected within the limits of the optical scale by manual input at the operator level.

It will be apparent to those skilled in the art that various modifications and variations can be made in the present invention without departing from the scope and spirit of the invention. For example, features described as part of one embodiment can be used on another embodiment to yield a still further embodiment. It is intended that the present invention cover such modifications and variations as come within the scope of the appended claims and their equivalents.

We claim:

1. A process for piecing in a textile spinning machine with optimal piecing parameters when batches of material processed by the spinning machine are changed, comprising:

changing batches of material processed by the spinning machine;

inputting machine data which changes as a result of changing batches of material into a memory of a central machine control;

transmitting the machine data from the central machine control to a travelling piecing device for a piecing operation, the piecing device having a microcomputer configured for executing a piecing program and having a data base of functional piecing parameters;

computing with the piecing device microcomputer a basic set of optimal piecing parameters corresponding to the transmitted machine data, the basic set of parameters having a minimal number of piecing parameters required for a piecing operation;

displaying the set of optimal piecing parameters at an operator control station in operable communication with the piecing device before the piecing operation;

manually changing any combination of the displayed optimal piecing parameters by an operator at the operator control station within preset limits; and piecing with the piecing device as a function of the manually adjusted optimal piecing parameters.

2. The process as in claim 1, comprising incorporating certain piecing parameters into other piecing parameters according to functional dependence of the parameters prior to said displaying in order to reduce the number of piecing parameters displayed to the operator.

3. The process as in claim 1, wherein said displaying comprises displaying an optimal set of piecing parameters of any combination of piecing joint thickness, yarn end overlap in the piecing joint, yarn end preparation, rotational piecing speed, yarn tension, type of material, and number of piecing attempts.

4. The process as in claim 1, wherein said displaying comprises displaying the optimal set of piecing parameters on an optical scale having predetermined limits for adjustment of the piecing parameters.

* * * * *